US006283834B1

(12) United States Patent
Liauzu

(10) Patent No.: US 6,283,834 B1
(45) Date of Patent: Sep. 4, 2001

(54) DIAPHRAGM-SUPPORT DISC FOR A POLISHING MACHINE AND METHOD OF OPERATING A POLISHING MACHINE

(75) Inventor: Luc Liauzu, Grenoble (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/304,314

(22) Filed: May 3, 1999

(30) Foreign Application Priority Data

May 4, 1998 (FR) ..... 98 05615

(51) Int. Cl.[7] ..... B24B 1/00

(52) U.S. Cl. ..... 451/41; 451/285; 451/288; 451/398

(58) Field of Search ..... 451/41, 285, 287, 451/288, 397, 398

(56) References Cited

U.S. PATENT DOCUMENTS

| | | | | |
|---|---|---|---|---|
| 5,423,716 | | 6/1995 | Strasbaugh . | |
| 5,584,746 | * | 12/1996 | Tanaka et al. | 451/288 |
| 5,624,299 | * | 4/1997 | Shendon | 451/285 |
| 5,635,083 | | 6/1997 | Breivogel et al. . | |
| 5,851,140 | * | 12/1998 | Barnes et al. | 451/288 |
| 5,879,220 | * | 3/1999 | Hasegawa et al. | 451/288 |
| 5,964,653 | * | 10/1999 | Perlov et al. | 451/285 |

FOREIGN PATENT DOCUMENTS 0 841 123 A1 5/1998 (EP) .

0 879 678 A1 11/1998 (EP) .

OTHER PUBLICATIONS

French Search Report dated Jan. 22, 1999 with annex on French Application No. 98–05615.

* cited by examiner

*Primary Examiner*—Eileen P. Morgan
(74) *Attorney, Agent, or Firm*—Theodore E. Galanthay; Stephen Bongini; Fleit, Kain, Gibbons, Gutman & Bongini P.L.

(57) ABSTRACT

A diaphragm-support disc for a polishing machine of the type in which a work piece to be polished is sandwiched between a radial front face of a diaphragm and a polishing surface or cloth. The diaphragm is extended across and wrapped around the peripheral edge of a radial front face of the disc, and a radial rear face of the diaphragm is subjected to pressure from a fluid. The diaphragm-support disc includes a main annular part that projects from the radial front face of the disc and is located in a peripheral region of the radial front face of the disc a predetermined distance from the peripheral edge of the radial front face of the disc. The main annular part can act on the work piece through the diaphragm so as to press the work piece onto the polishing surface or cloth by an axial displacement of the disc with respect to the polishing surface or cloth. In a preferred embodiment, a shorter secondary annular part projects from the radial front face of the disc on the peripheral edge of the radial front face of the disc some distance from the main annular part. A method of operating a polishing machine to polish a work piece is also provided.

16 Claims, 2 Drawing Sheets

DIAPHRAGM-SUPPORT DISC FOR A POLISHING MACHINE AND METHOD OF OPERATING A POLISHING MACHINE

CROSS-REFERENCE TO RELATED APPLICATIONS

This application is based upon and claims priority from prior French Patent Application No. 98-05615, filed May 4, 1998, the entire disclosure of which is herein incorporated by reference.

BACKGROUND OF THE INVENTION

1. Field of the Invention

The present invention relates to polishing machines, and more specifically to polishing machines for the mechano-chemical polishing of integrated circuit wafers during manufacturing.

2. Description of Related Art

With conventional polishing machines, the wafer to be polished is sandwiched between a pressing diaphragm of a rotary head that rotates the wafer and the surface of a rotary polishing platen. The polishing is performed by virtue of an abrasive in suspension in a liquid that is made to flow between the wafer and the polishing platen. The polishing head includes a disc that bears the diaphragm on its periphery, and a fluid exerts a pressure on this membrane through the disc in order to press the wafer against the polishing surface in a controlled manner. When abrasives in suspension of the colloid type are used with such a polishing machine, there exists a drawback in that the central part of the wafer is perfectly polished but a region near the peripheral edge of the wafer has a significantly smaller thickness removed.

SUMMARY OF THE INVENTION

In view of these drawbacks, it is an object of the present invention to overcome the above-mentioned drawbacks and to provide a diaphragm-support disc for a polishing machine that improves the uniformity of polishing and the flatness of the polished surface. A main annular part projects from a radial front face of the disc in a peripheral region of the radial front face a predetermined distance from the peripheral edge of the radial front face. Thus, the main annular part can act on the work piece to be polished through the diaphragm so as to press the work piece to be polished onto the polishing surface by an axial displacement of the disc with respect to the polishing surface.

Another object of the present invention is to provide a diaphragm-support disc that is specially suited for a polishing machine in which the diaphragm extend across a radial front face of the disc and wraps around the peripheral edge of the front face, with a fluid subjecting pressure on the radial rear face of the diaphragm (i.e., on the disc side). A work piece to be polished is sandwiched between the radial front face of the diaphragm and a polishing surface or cloth. The polishing machine polishes the work piece in a mechano-chemical manner using an abrasive component that flows between the work piece and the polishing surface.

A further object of the present invention is to provide a method for operating a polishing machine that uses such a disc.

Yet another object of the present invention is to provide a polishing machine for the mechano-chemical polishing of a circular integrated circuit wafer using an abrasive component that flows between the wafer and a polishing surface.

One embodiment of the present invention provides a diaphragm-support disc for a polishing machine of the type in which a work piece to be polished is sandwiched between a radial front face of a diaphragm and a polishing surface or cloth. The diaphragm is extended across and wrapped around the peripheral edge of a radial front face of the disc, and a radial rear face of the diaphragm is subjected to pressure from a fluid. The diaphragm-support disc includes a main annular part that projects from the radial front face of the disc and is located in a peripheral region of the radial front face of the disc a predetermined distance from the peripheral edge of the radial front face of the disc. The main annular part can act on the work piece through the diaphragm so as to press the work piece onto the polishing surface or cloth by an axial displacement of the disc with respect to the polishing surface or cloth. In a preferred embodiment, a shorter secondary annular part projects from the radial front face of the disc on the peripheral edge of the radial front face of the disc some distance from the main annular part.

Another embodiment of the present invention provides a method of operating a polishing machine to polish a work piece. The polishing machine is of the type that includes a polishing surface or cloth, a diaphragm-support disc, and a diaphragm positionable so that the work piece is sandwiched between a radial front face of the diaphragm and the polishing surface or cloth. The diaphragm is extended across and wrapped around the peripheral edge of the radial front face of the disc. According to the method, a main annular part is provided so as to project from a peripheral region of the radial front face of the disc a predetermined distance from the peripheral edge of the radial front face of the disc. A fluid is used to exert pressure on a radial rear face of the diaphragm so as to press the work piece onto the polishing surface or cloth, and the main annular part is used to exert pressure on a radial rear face of the diaphragm so as to press a peripheral region of the work piece onto the polishing surface or cloth. In one preferred method, the pressure exerted by the fluid on the diaphragm is less than or equal to the pressure exerted by the main annular part on the diaphragm.

Other objects, features, and advantages of the present invention will become apparent from the following detailed description. It should be understood, however, that the detailed description and specific examples, while indicating preferred embodiments of the present invention, are given by way of illustration only and various modifications may naturally be performed without deviating from the present invention.

DETAILED DESCRIPTION OF PREFERRED EMBODIMENTS

Preferred embodiments of the present invention will be described in detail hereinbelow with reference to the attached drawings.

Figure 1:
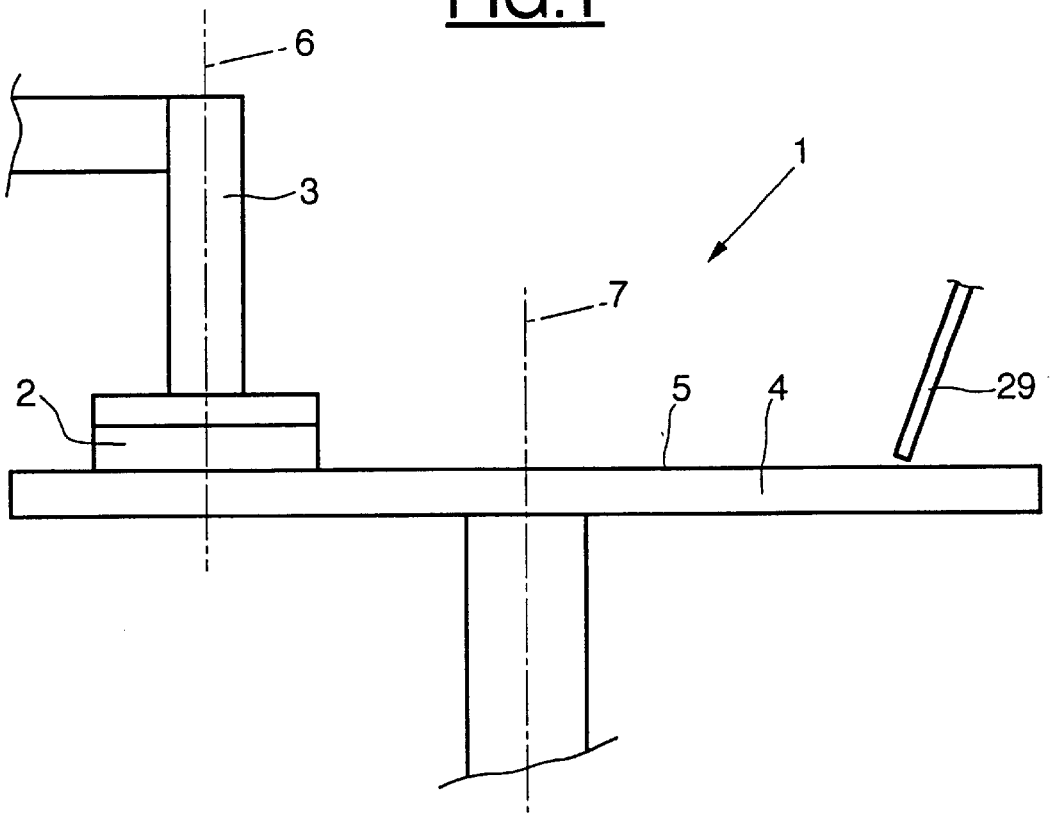
FIG. 1 is a diagram showing an exterior view of a polishing machine.

As shown in FIG. 1, a polishing machine 1 includes a rotary head 2, which is borne by an arm 3 of a displacement system (not shown) and connected to a rotational-drive system (not shown), and a rotary polishing cloth or platen 4, which is connected to a rotational-drive system (not shown). The platen 4 has a radial surface 5 on which rests the front face of the rotary head 2. The vertical axis 6 of the rotary head 2 is offset from the vertical axis 7 of the polishing platen 4, and the rotary head 2 extends over only a portion of the platen that is located between its axis and peripheral edge.

Figure 3:
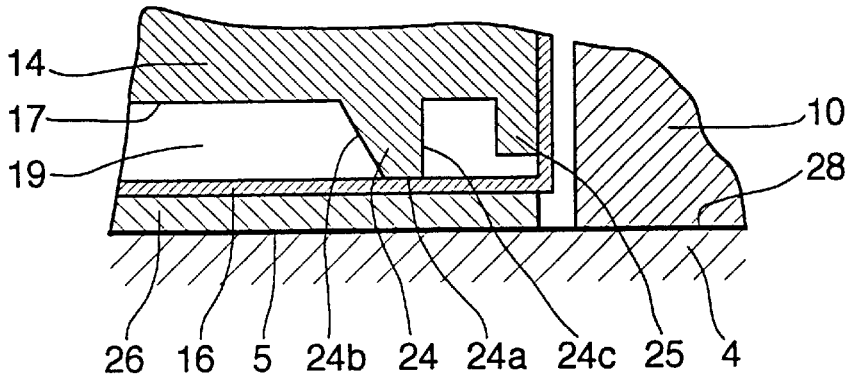
FIG. 3 is a cross-section showing an enlarged and partial axial section of the disc of the rotary head of FIG. 2.
Figure 2:
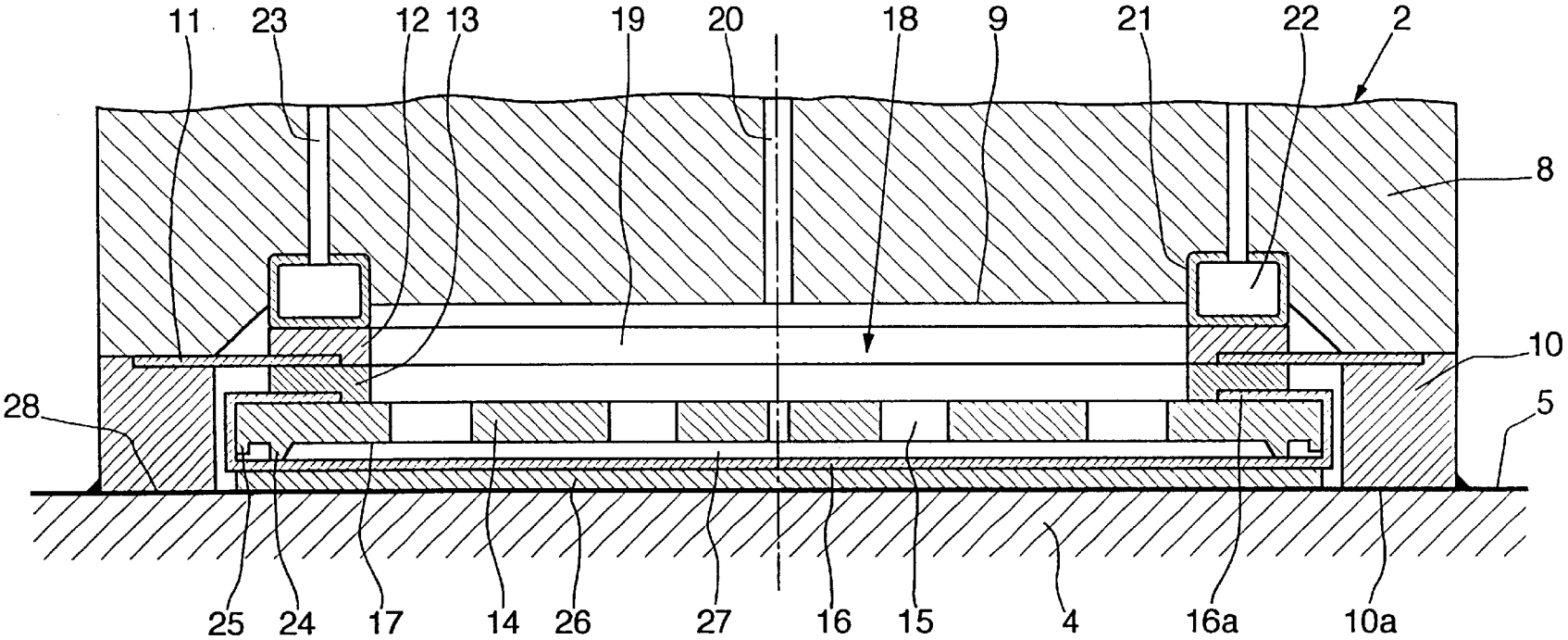
FIG. 2 is a cross-section showing an axial section through the head of the polishing machine of FIG. 1.

Referring to FIGS. 2 and 3, the rotary head 2 includes a cylindrical body 8 that bears an annular ring 10 and a flat annular diaphragm 11 against the periphery of its lower front face 9. The outer peripheral portion of the diaphragm 11 is sandwiched and fixed between the front face 9 of the body 8 and the rear face of the annular ring 10, and the inner part of the diaphragm 11 is sandwiched and fixed between rear and front intermediate flat rings 12 and 13, respectively. The rotary head 2 also includes a front disc 14 that is fixed on and further forward than the ring 13. Through passages 15 are made in the central part of the front disc 14 in the direction of its thickness.

Additionally, the rotary head includes a diaphragm 16 that extends across the flat radial front face 17 of the disc 14. The diaphragm 16 wraps around the periphery 5 of the front disc 14 such that the annular edge 16*a* of the diaphragm is sandwiched between the rear face of the disc 14 and the front face of the front intermediate ring 13. Thus, the intermediate rings 12 and 13, the disc 14, and the diaphragm 16 form an assembly 18 that is suspended from the body 8 via the annular diaphragm 11. The central part of the front face 9 of the body 8, the annular diaphragm 11, and the diaphragm 16 determine a fluid chamber 19 across which the disc 14 extends, and the body 8 has an axial duct 20 that allows the chamber 19 to be connected to an external pressure-adjustable source of fluid.

Furthermore, the front face 9 of the body 8 has an annular recess in the chamber 19 in which is housed a fluid-filled annular roll 21 that can press against the rear face of the rear intermediate ring 12. The body 8 has ducts 23 that allow the roll 22 to be connected to an exterior pressure-adjustable source of fluid. The radial front face 17 of the disc 14 has a main annular rib or part 24 projecting forward in the peripheral region and some distance from the peripheral edge, and a secondary annular rib or part 25 projecting forward on the peripheral edge. The secondary part 25 is not as thick as the main annular part 24. The annular end 24*a* of the main annular part 24 is flat and radial, and the main annular part 24 has an interior flank 24*b* that is inclined (e.g., at 45°) and an exterior flank 24*c* that is substantially straight.

The operation of the polishing machine 1 will now be explained. At a loading station, the polishing head 2 takes on a wafer 26 to be polished by pressing the wafer up against the front face of the diaphragm 16 using a partial vacuum that is created in the chamber 19. Next, the polishing head 2 is brought into a position such that the front face 10*a* of the peripheral annular ring 10 is arranged a small distance from the radial surface 5 of the polishing platen 4. Pressure is then established in the chamber 19 and in the annular roll 22. The pressure exerted in the chamber 19 urges the diaphragm 16 forward so that there is a space 27 between the front face 17 of the disc 14 and the diaphragm 16. Thus, the diaphragm presses the wafer 26 to be polished against the surface 5 of the polishing platen 4 in a uniformly spread fashion.

The pressure exerted in the annular roll 22 acts on the periphery of the rear face of the disc 14 such that the front end face 24*a* of the projecting annular part 24 of the disc 14 (which is displaced axially) acts forward, locally, and in an annulus on the diaphragm 16 so as to exert a local and annular pressure on the peripheral region of the wafer 26 to be polished and towards the radial surface 5 of the polishing platen 4 some distance from the peripheral edge. As the rotary head 2 and the platen 4 are each rotated and as the wafer 26 to be polished is rotated because it adheres to the diaphragm 16, an abrasive component 28 containing a particulate abrasive in suspension in a liquid is deposited on the radial surface 5 of the platen 4 by a feed system 29 (see FIG. 1). For example, the abrasive component 28 can be a colloid abrasive in suspension in an appropriate liquid (i.e., an abrasive whose particles do not clump together).

The abrasive component 28 spreads out over the radial surface 5, which for this purpose preferably has fine circumferential grooves (not shown), and flows between the wafer 26 to be polished and the radial surface 5 of the polishing platen 4 so as to polish the face of the wafer 26 that faces the platen 4. At the same time, the polishing head 2 can be displaced radially with respect to the polishing platen 4. The pressure exerted on the diaphragm 16 by the fluid in the chamber 19 should be equal to or preferably less than the pressure exerted by the main annular part 24 on the diaphragm 16.

The combined action or combination of pressures (or forces) exerted on the diaphragm 16 and transmitted to the wafer 26 to be polished by an appropriate adjustment of the pressure of the fluid in the chamber 19 and of the pressure exerted by the projecting annular part 24 makes it possible to obtain uniform polishing, and thus a polished surface of the wafer 26 that is flat or practically flat. After polishing, a partial vacuum is created in the chamber 19 and the head 2 takes the polished wafer 26 to an unloading station.

In one illustrative embodiment of the present invention, for polishing an integrated circuit wafer that has a thickness of between half a millimeter and one millimeter, a diameter of about two hundred millimeters, and is to have removed a thickness of between 500 nanometers and one micron, the disc 14 has a diameter of about two hundred millimeters, the main annular rib or part 24 is formed about five millimeters from the peripheral edge of the disc 14 with a thickness of about one and a half millimeters, the front surface 24*a* of the main annular rib or part 24 has a width of between one and two millimeters, and the secondary annular rib or part 25 has a width of about one millimeter and a thickness of about half a millimeter.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, other embodiments of the present invention may not include all of the features described above. Therefore, it is intended that the present invention not be limited to the particular embodiments disclosed, but that the invention include all embodiments falling within the scope of the appended claims.

What is claimed is:

1. A diaphragm-support disc for a polishing machine of the type in which a work piece to be polished is sandwiched between a radial front face of a diaphragm and a polishing surface or cloth, the diaphragm being extended across a radial front face of the disc and wrapped around a peripheral edge of the radial front face of the disc, and a radial rear face of the diaphragm being subjected to pressure from a fluid, said diaphragm-support disc comprising:

a main annular part projecting from the radial front face of the disc, the main annular part being located in a peripheral region of the radial front face of the disc and a predetermined distance from the peripheral edge of the radial front face of the disc; and a secondary annular part projecting from the radial front face of the disc, the secondary annular part being located on the peripheral edge of the radial front face of the disc, wherein during polishing of the workpiece, the main annular part physically contacts the diaphragm so as to press the diaphragm against the work piece and press the work piece onto the polishing surface or cloth by an axial displacement of the disc with respect to the polishing surface or cloth, and the secondary annular part does not extend as far from the radial front face of the disc as the main annular part, and the main annular part is located some distance from the secondary annular part.

2. The diaphragm-support disc as defined in claim 1, wherein the main annular part acts on the work piece in the region of a distal end of the main annular part, and the distal end of the main annular part is flat.

3. The diaphragm-support disc as defined in claim 2, wherein the main annular part is located so as to press the diaphragm against the workpiece at a location that is some distance from the peripheral edge of the work piece.

4. The diaphragm-support disc as defined in claim 1, wherein the main annular part is located so as to press the diaphragm against the workpiece at a location that is some distance from the peripheral edge of the work piece.

5. The diaphragm-support disc as defined in claim 1, wherein the main annular part has at least one inclined flank.

6. A polishing machine for polishing a work piece, said polishing machine comprising:

a polishing surface or cloth;

a diaphragm positionable so that the work piece is sandwiched between a radial front face of the diaphragm and the polishing surface or cloth;

a diaphragm-support disc, the diaphragm being extended across a radial front face of the disc and wrapped around a peripheral edge of the radial front face of the disc;

a main annular part projecting from the radial front face of the disc, the main annular part being located in a peripheral region of the radial front face of the disc and a predetermined distance from the peripheral edge of the radial front face of the disc; and a secondary annular part projecting from the radial front face of the disc, the secondary annular part being located on the peripheral edge of the radial front face of the disc, wherein during polishing of the workpiece, the main annular part physically contacts the diaphragm so as to press the diaphragm against the work piece and press the work piece onto the polishing surface or cloth by an axial displacement of the disc with respect to the polishing surface or cloth, and the secondary annular part does not extend as far from the radial front face of the disc as the main annular part, and the main annular part is located some distance from the secondary annular part.

7. The polishing machine as defined in claim 6, wherein the main annular part acts on the work piece in the region of a distal end of the main annular part, and the distal end of the main annular part is flat.

8. The polishing machine as defined in claim 7, wherein the main annular part is located so as to press the diaphragm against the workpiece at a location that is some distance from a peripheral edge of the work piece.

9. The polishing machine as defined in claim 6, wherein the main annular part is located so as to press the diaphragm against the workpiece at a location that is some distance from a peripheral edge of the work piece.

10. The polishing machine as defined in claim 6, wherein the main annular part has at least one inclined flank.

11. The polishing machine as defined in claim 6, wherein a fluid subjects pressure on a radial rear face of the diaphragm.

12. The polishing machine as defined in claim 6, wherein the work piece is a circular integrated circuit wafer.

13. The polishing machine as defined in claim 12, wherein an abrasive component flows between the wafer and the polishing surface or cloth.

14. A method of operating a polishing machine to polish a work piece, the polishing machine of the type including:

a polishing surface or cloth;

a diaphragm positionable so that the work piece is sandwiched between a radial front face of the diaphragm and the polishing surface or cloth; and a diaphragm-support disc, the diaphragm being extended across a radial front face of the disc and wrapped around a peripheral edge of the radial front face of the disc, said method comprising the steps of:

providing a main annular part that projects from the radial front face of the disc in a peripheral region of the radial front face of the disc and a predetermined distance from the peripheral edge of the radial front face of the disc;

using a fluid to exert pressure on a radial rear face of the diaphragm so as to press the work piece onto the polishing surface or cloth;

during polishing of the workpiece, using the main annular part to physically contact a radial rear face of the diaphragm so as to press the diaphragm against the workpiece and press a peripheral region of the work piece onto the polishing surface or cloth; and providing a secondary annular part that projects from the radial front face of the disc on the peripheral edge of the radial front face of the disc, wherein the secondary annular part does not extend as far from the radial front face of the disc as the main annular part, and the main annular part is located some distance from the secondary annular part.

15. The method as defined in claim 14, wherein the pressure exerted by the fluid on the diaphragm is less than or equal to the pressure exerted by the main annular part on the diaphragm.

16. The method as defined in claim 14 wherein the work piece is a circular integrated circuit wafer.

* * * * *